United States Patent [19]

Kulick

[11] Patent Number: 4,805,901

[45] Date of Patent: Feb. 21, 1989

[54] COLLAPSIBLE EXERCISE DEVICE

[76] Inventor: John M. Kulick, 9 Gemstone Dr., Collinsville, Conn. 06022

[21] Appl. No.: 36,081

[22] Filed: Apr. 9, 1987

[51] Int. Cl.[4] ..... A63B 21/00; A47C 13/00

[52] U.S. Cl. ..... 272/73; 297/118; 297/119

[58] Field of Search ..... 272/72, 73, 129, 132, 272/144, 134; 128/25 R; 297/118, 119, 193, 462; 5/2 R, 5; 206/315.1

[56] References Cited

U.S. PATENT DOCUMENTS

| | | | |
|---|---|---|---|
| 938,399 | 10/1909 | Schaufler | 272/142 |
| 955,793 | 4/1910 | Harris | 272/73 |
| 1,715,870 | 6/1929 | Spain | 272/72 |
| 2,548,408 | 4/1951 | Tammen | 128/25 R |
| 2,756,743 | 7/1956 | Clark | 128/25 R |
| 2,786,512 | 9/1984 | McFee | 272/73 |
| 2,924,214 | 2/1960 | Zak | 272/129 |
| 3,127,171 | 3/1964 | Noland et al. | 272/132 |
| 3,189,344 | 6/1965 | Swarts | 272/73 |
| 3,738,649 | 6/1973 | Miller | 272/73 |
| 3,767,195 | 10/1973 | Dimick | 272/73 |
| 3,968,963 | 7/1976 | Sileo | 272/134 |
| 4,300,761 | 11/1981 | Howard | 272/134 |
| 4,358,105 | 11/1982 | Sweeney, Jr. | 272/73 |
| 4,466,613 | 8/1984 | Reese | 272/142 |
| 4,489,938 | 12/1984 | Darzinskis | 272/142 |

*Primary Examiner*—Richard J. Apley
*Assistant Examiner*—S. R. Crow
*Attorney, Agent, or Firm*—Ira S. Dorman

[57] ABSTRACT

An ottoman-like furniture piece serves as a storage unit for an integrated collapsible exercising mechanism. The housing of the unit can be converted to form a chair on which the subject may sit during exercise, and the unique construction of the mechanism enables it to be readily folded into a compact configuration for storage.

24 Claims, 4 Drawing Sheets

COLLAPSIBLE EXERCISE DEVICE

BACKGROUND OF THE INVENTION

Equipment for exercising the more powerful muscle groups of the human body is often large, cumbersome and unattractive, usually causing it to be relegated to fitness centers, gymnasiums, and the like. Proposals have been made for constructing such apparatus so that it can be stored within a cabinet, to make it more suitable for home use, and in some instances the storage units have taken the form of various pieces of furniture.

More particularly, Noland et al U.S. Pat. No. 3,127,171 discloses exercise apparatus comprised of pedals and weights, which is associated with a furniture-like storage chest. The exterior side and end walls of the chest are covered with a material such as plastic or leather, and the lid may, in addition, be padded for comfort during exercise.

In U.S. Pat. No. 3,738,649, Miller discloses an exercise unit in the form of a chair which has a space beneath its seat portion and a platform upon which the exercising devices (e.g., a bicycle pedal system) are mounted.

A chair-type bicycle exercise device is also shown in Sileo U.S. Pat. No. 3,968,963; in one embodiment, guide means is affixed to the undersurface of the seat of the chair for slidably accommodating and supporting the frame on which the pedals are mounted.

Howard U.S. Pat. No. 4,300,761 provides a rectangular cabinet for storing an associated articulated body-support platform, on which a foot pedal assembly may be mounted.

The portable unit disclosed in Reese U.S. Pat. No. 4,466,613 also comprises a box in which the exercise components are stored.

It is generally desirable for exercise equipment to have a variable resistance feature, to best accommodate individual capacities and to permit adjustment during progress through an exercise regimen. Selective variation is commonly achieved by the addition and removal of weight, by making tension adjustments, by changing pneumatic or hydraulic pressure, and by controlling voltages to increase and decrease magnetic field strength. Of late, certain forms of exercising apparatus have been furnished with digital display features, which not only enables monitoring of resistance and work output levels, for physiologic reasons, but also helps to maintain interest and to promote a sense of achievement.

Exemplary of the prior art of interest in regard to these concepts are Schaufler U.S. Pat. No. 938,399 and Harris U.S. Pat. No. 955,793, both of which provide exercising apparatus in which electrical current is conducted to the body of the user.

McFee U.S. Pat. No. 2,786,512, discloses an arrangement for dissipating user-generated energy through various devices, such as an alternator.

Dimick U.S. Pat. No. 3,767,195 provides an exercise bicycle in which the torque load on the pedals is adjusted, through a predetermined cycle of operation, using a servo motor to apply a frictional loading to a flywheel.

The bicycle exerciser of Sweeney, Jr. U.S. Pat. No. 4,358,105 utilizes an alternator to provide a variable resistance, and it incorporates computer and display electronics features.

In Darzinskis U.S. Pat. No. 4,489,936, an exercise device is combined with video computer apparatus to make its use more interesting and pleasant.

It is a broad object of the present invention to provide a novel self-contained exercise and ottoman-like unit, the latter being convertible to provide a chair in which the user can sit while operating the exercising mechanism.

It is a more specific object of the invention to provide such a unit which is aesthetically appealing in its closed configuration, and is effective and comfortable for its exercising functions, is of relatively uncomplicated and inexpensive construction, and is readily convertible between its alternative configurations.

Another object of the invention is to provide a novel collapsible exercising mechanism adapted for attachment to and containment within a storage unit, such as may be of ottoman-like form.

A further object is to provide such a novel exercising mechanism which is of relatively uncomplicated and inexpensive construction, is readily collapsed for storage purposes and erected for operation, and is convenient and effective to use.

SUMMARY OF THE INVENTION

It has now been found that certain of the foregoing and related objects of the invention are attained by the provision of an ottoman-like unit that is convertible to permit use for exercising in seated position, comprising a housing defining an interior storage compartment. A floor-supported chassis provides upper horizontal support structure and vertical support structure at its forward end, and the unit includes a displaceable platform member that is dimensioned and configured to span, and substantially cover, the top of the chassis when it is disposed in a normal position on the horizontal support structure. Means is provided for mounting the platform member on the chassis for movement between its normal horizontal position and an alternative erected position in which it extends obliquely from a location spaced from the forward end of, and across, the chassis. An end panel, dimensioned and configured to span the forward end of the chassis and to extend over a substantial portion of its height, is normally disengageably as mounted by suitable means. The horizontal support structure of the chassis is adapted to support the end panel in a generally horizontal alternative position, in which it extends substantially across the chassis and between the "spaced" location and the forward end thereof. As a result, the platform member and the end panel cooperatively provide a chair arrangement in their alternative positions serving, respectively, as the backrest and the seat. The unit also includes a leg exercising mechanism, which is adapted for containment within the storage compartment of the housing and for attachment to the housing in a forwardly extended position, for operation by a person seated in the chair arrangement.

The mounting means for the platform member may, more specifically, comprise a stand piece, which includes an elongated leg that is pivotably mounted to the chassis at one end, and that pivotably mounts the platform member at a point spaced from it, the stand piece and platform member having cooperating means for affixing the latter against relative pivotal movement in its erected, alternative position. The stand may also have a foot portion which projects from the leg and is disposed to provide support in the alternative position of the platform member; in that case, the chassis may have an opening to accommodate the foot portion in the "normal" position of the platform member. An abutment piece may be mounted on the chassis for selective positioning either over or displaced from the opening, to provide underlying support for the foot portion when positioned over the opening, thereby enabling the stand piece to support the platform member in its alternative position.

A bracket may be disposed at the forward end of the chassis to provide its vertical support structure, as well as the means by which the exercising mechanism is attached to the housing, and the end panel and chassis will normally have cooperating means thereon for disposing the end panel in a forwardly inclined orientation, to lie in substantially right-angular relationship to the platform member in their alternative positions. The chassis will desirably include ramp structure for facilitating insertion and removal of the exercising mechanism into and from the compartment of the housing, with suitable means, adapted for cooperation with the ramp structure, being provided on the exercising mechanism.

Other objects of the invention are attained by the provision of a collapsible exercising mechanism, which comprises an elongated frame having ground-engaging members adjacent its opposite ends, and an exercising system on the frame including operatively interconnected dynamic resistance means and manual drive means. The mechanism will also have a member that is adapted for attaching it to a storage unit, and a member that is adapted to provide underlying support for the frame. The supporting member is mounted on the frame for movement between a storage position, proximate thereto, and a supporting position extended downwardly therefrom; it also has an outer end portion with ground-engaging means thereon which is capable of stably engaging an underlying surface. Usually, the attaching member will be mounted on the frame for movement between a storage position proximate thereto and an attaching position extended rearwardly from it, and preferably the attaching and supporting members will both be elongated and pivotably mounted adjacent one end on the frame to extend along the top and bottom thereof in their storage positions.

In most instances, the manual drive means of the exercising system will comprise a wheel (generally a sprocket) and pedal assembly rotatably mounted on the frame, to adapt the mechanism for leg exercising operation. The resistance means will preferably be capable of offering selectively variable resistances, and it will advantageously be an electric machine having a stator and a magnetically coupled rotor, with means also being provided for selectively varying the strength of the magnetic field. More specifically, the exercising system may comprise an alternator and a pulley operatively connected to the pedal assembly by power transmission means, adapted for driving the alternator at high rates of revolution. The system may also include coupling means for electrically connecting external devices to the machine, which may serve to impose resistance loads thereupon.

DETAILED DESCRIPTION OF THE ILLUSTRATED EMBODIMENT

Figure 1:
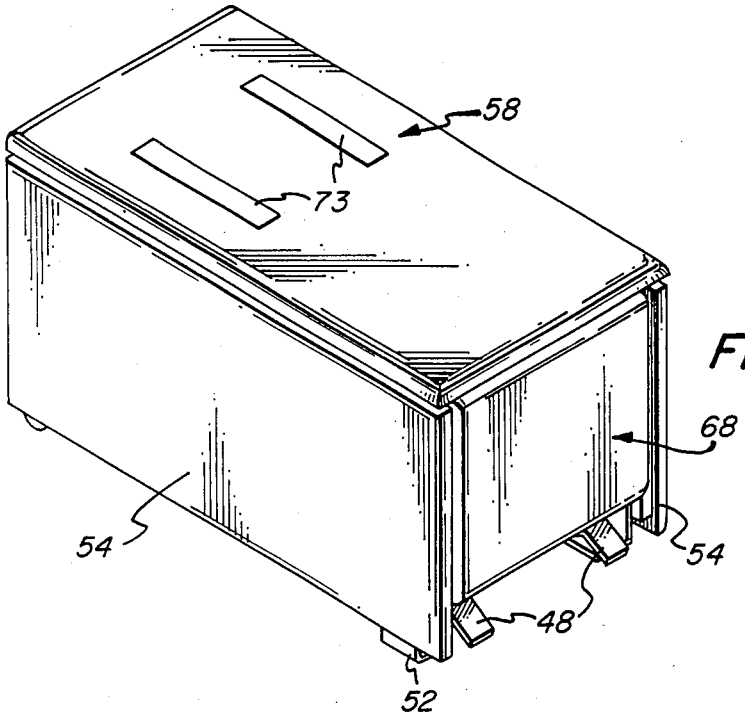
FIG. 1 is a perspective view of an ottoman-like unit embodying the present invention.
Figure 2:
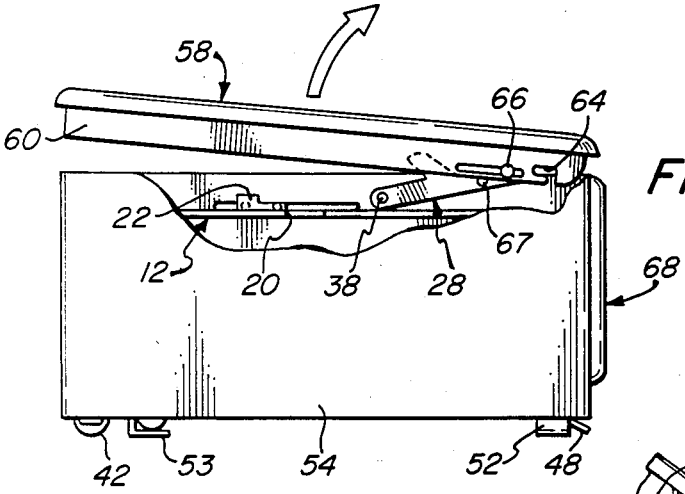
FIG. 2 is a side elevational view of the unit of FIG. 1, with portions of the sidewall broken away to expose internal features, and showing the platform member in an initial stage of displacement.
Figure 3:
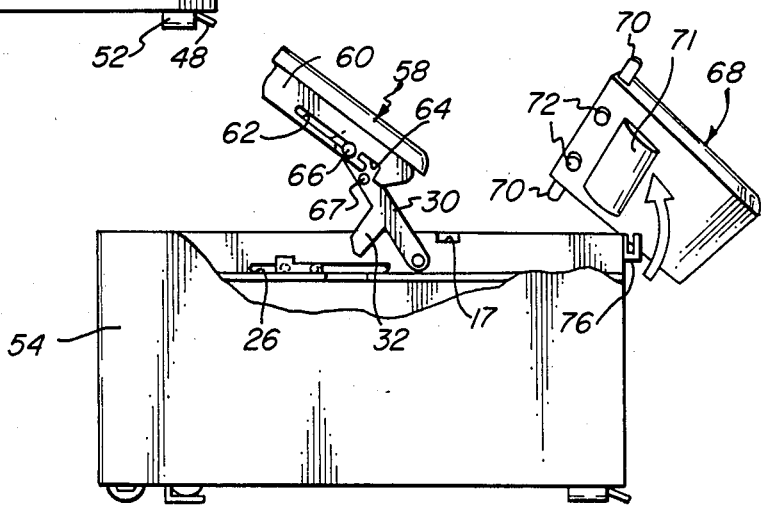
FIG. 3 is a view similar to FIG. 2, showing the end panel removed, preliminary to positioning for its seat-providing function, with the platform in a further phase of elevation.

Turning now in detail to the appended drawings, therein illustrated is an exercising unit embodying the present invention, constructed to provide an ottoman-like piece of furniture when the exercising mechanism is in its collapsed and stored condition. The unit includes a housing built upon a welded metal chassis, the latter consisting of a pair of inverted U-shaped end pieces connected by upper and lower brace pieces extending longitudinally along the two opposite sides, generally designated respectively by the numerals 10, 12, 14. The upper brace pieces 12 are constructed of angle-iron, and are disposed with their vertical portions 16 directed upwardly and their horizontal portions 18 extending outwardly; the vertical portions 16 are downwardly notched at 17, and the horizontal portions 18 are slotted at 20. A support block 22 is slidably seated upon the upper surface of the horizontal portion 18, and has laterally extending retaining bolts 24 engaged within the elongated slot 26 of the vertical portion 16 to secure it in assembly.

A Y-shaped stand piece, generally designated by the numeral 28, includes a relatively long leg 30 and a foot 32 extending at an angle from the leg. As will be appreciated, the slot 20 is dimensioned to enable the foot 32 to pass through the horizontal portion 18, and the block 22 is formed with a step to provide a seating surface 34 upon which the bottom edge 36 of the foot 32 may rest; the stand piece 28 is pivotably attached at one end of the leg 30 to the vertical portion 16 of the upper brace piece 12 by a rivet 38.

The lower brace pieces 14 are also of right-angle form, and include vertical portions 40 which are welded at their opposite ends to the U-shaped pieces 10. Two angle pieces 44, 53 extend laterally between the lower side pieces 14 of the chassis, and a pair of wheels 42 are mounted through the horizontal portion of the rearmost piece 44. The horizontal portions 46 of the brace pieces 14 extend inwardly toward one another, and each is jointed to the associated vertical portion 40 for most of its length; the forward end sections thereof are however disconnected, and are formed to provide inclined ramp elements 48 and shallow depressions 50 connecting the ramp elements 48 to the more rearward, connected portions. Inwardly-directed L-shaped foot pieces 52 are attached to the forward ends of the vertical portions 40 and provide, in cooperation with the wheels 42, ground-engaging support for the unit.

The sides and rearward end of the chassis are covered with padded panels 54, 56, attached thereto by suitable means (not shown). The top of the chassis is covered by a rectangular platform 58, which is also padded and is mounted upon the pair of pivotable stand pieces 28. For that purpose, the platform 58 has flange elements 60 which extend downwardly along its opposite lateral margins, each having a slot 62 extending longitudinally therealong and an L-shaped edge notch 64. The leg 30 of each stand piece 28 carries a pair of rivets 66, 67, the shank portions of which are of sufficiently small to permit slidable engagement within the slot 62 and notch 64, respectively. It will be appreciated that the platform 58 will be affixed against pivotable movement about the outer rivet 66 when the inner rivet 67 is engaged within the notch 64, and that sliding the platform 58 outwardly along the stand pieces 28 will permit disengagement of the inner rivet 67 and, in turn, rotation about the outer rivet 66 and slidable movement of the platform within the limits of the slots 62.

Figure 4:
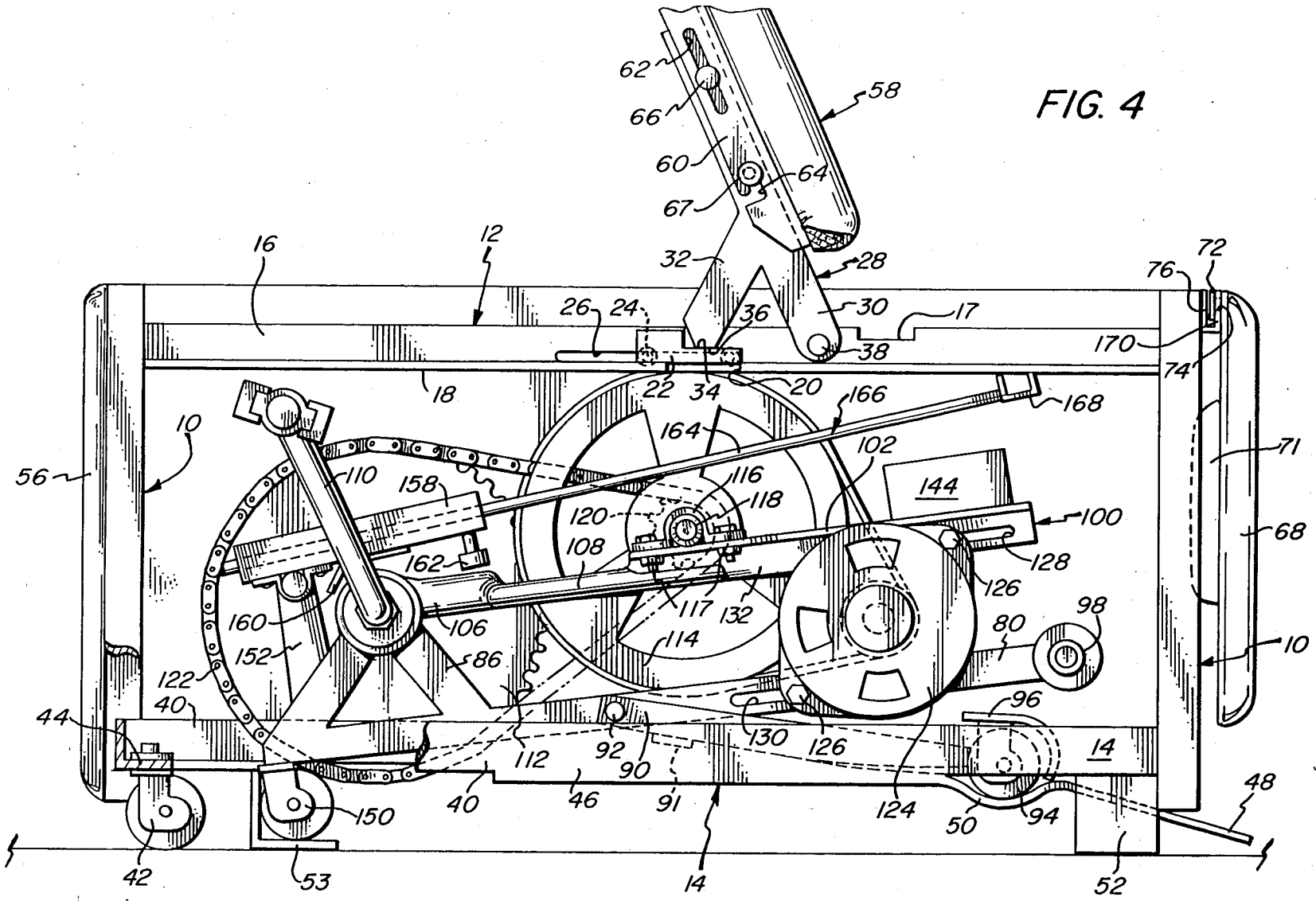
FIG. 4 is a side elevational view of the unit of the foregoing Figures, drawn to an enlarged scale and with the near side panel of the housing removed, showing the platform member fully erected and the end panel in its normal position.
Figure 5:
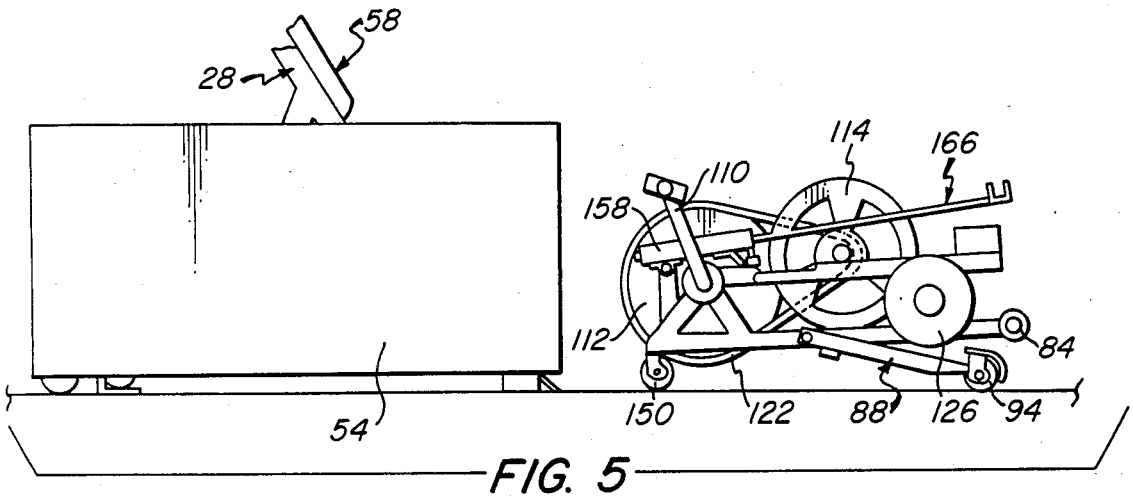
FIG. 5 is a further view similar to FIGS. 2 and 3, showing somewhat diagrammatically the collapsed exercising mechanism removed from the storage compartment within the housing of the unit.

FIGS. 1–4 illustrate the sequence of opening of the platform 58 from the closed (ottoman form) condition to an erected (exercise mode) configuration. Initially, the platform 58 is lifted to displace it from the position of FIG. 1; in doing so, it pivots in the clockwise direction, as indicated by the arrow in FIG. 2, with the stand pieces 28 pivoting counterclockwise about the rivets 38. In the course of doing so, the platform may be shifted lengthwise to permit insertion of the inner rivet 67 into the notch 64, which condition is imminent in the phase of opening depicted by FIG. 3. The blocks 22 on the upper brace pieces 12 are thereafter slid to positions over the respective openings 20, so that the foot 32 of each stand piece may be brought to rest upon the corresponding surface 34, to condition the platform 58 to serve as a backrest, as shown in FIG. 4. It will be appreciated that the position of the blocks 22 along the slots 26 may be varied to alter the angular orientation of the platform, for maximum user comfort as well as for functional exercise effect derived by causing working of different muscles.

Figure 7:
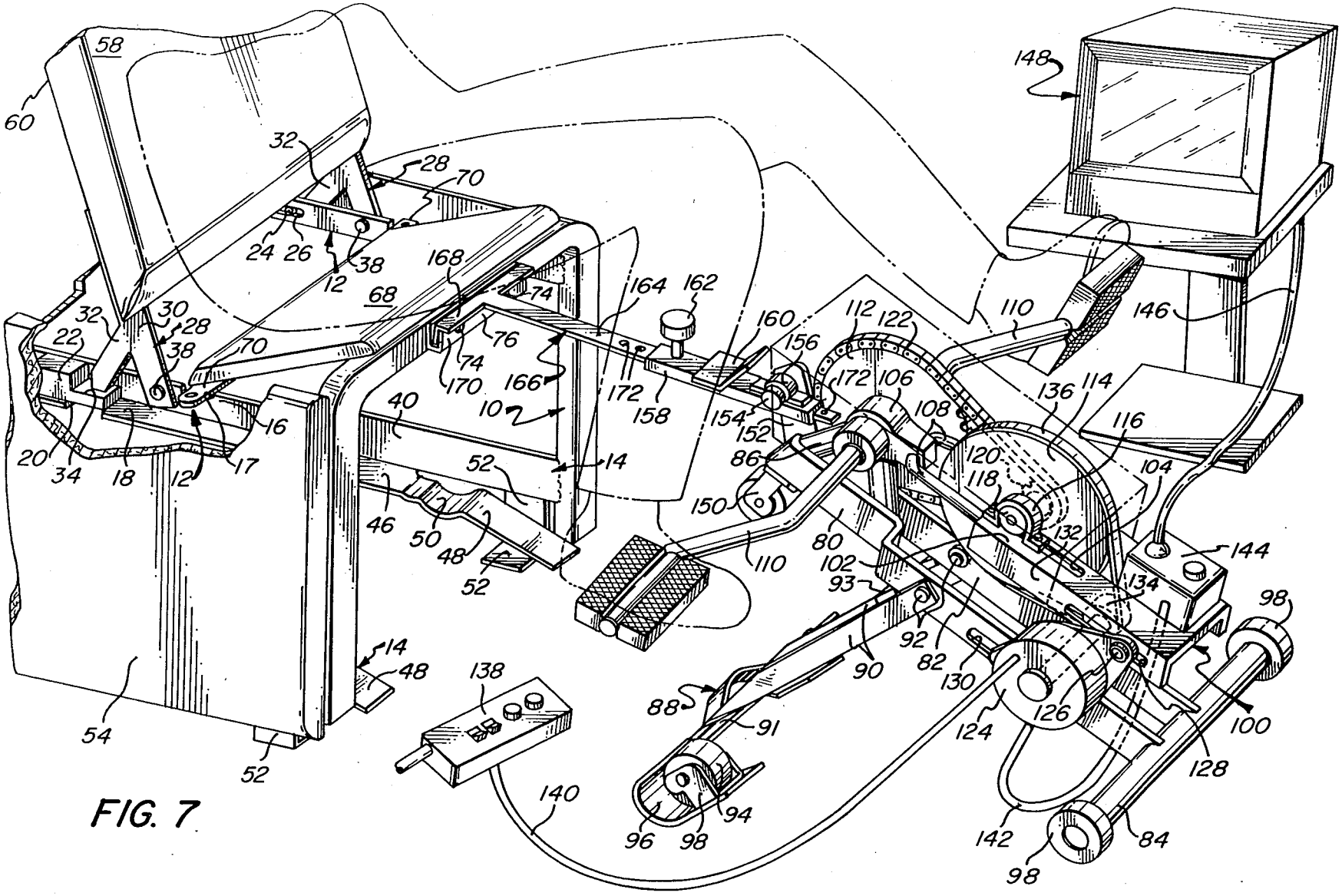
FIG. 7 is a fragmentary perspective view of the unit of the invention, showing the exercising mechanism being operated by a person seated in the chair arrangement formed by the platform member and end panel, to which a television receiver is connected as a resistance load.

The forward end of the chassis is also covered by a removable panel, generally designated by the numeral 68, which has a crosspiece thereon providing laterally extending ear portions 70 adjacent the upper edge of the panel, and serving to mount a pair of buttons 72; it also has a pillow 71 removably attached to it, such as by hook and loop-type fasteners (VELCRO), not shown. The end panel 68 is normally supported on the U-shaped piece 10 at the forward end of the chassis, by engagement of the buttons 72 within the side-by-side apertures 74 provided in the bracket 76, which is welded to the forward U-shaped piece 10. When the unit is opened for exercising, the end panel 68 is repositioned, as shown in FIG. 7, with the ear portions 70 engaged within the notches 17 in the edges of the upper brace pieces 12, and with what is normally the lower marginal portion of the panel resting upon the horizontal element of the chassis piece 10. Thus, the panel 68 serves as a seat portion and provides, in cooperation with the platform 58, a chair in which the user of the equipment may sit (as suggested in phantom line). The pillow 71 will normally be removed and attached to the platform 58 in a position suitable for providing head support, the strips 73 thereon being either of the cooperating components of VELCRO fasteners, to permit facile attachment at a comfortable level.

The exercising mechanism itself is best illustrated in FIGS. 4–7. It includes a frame made of two generally parallel bars 80, 82, across the forward end of which extends an elongated cylindrical axle 84 having enlarged circular end portions 98 thereon, and between the rearward ends of which is affixed a Vee-component 86. A stand assembly, generally designated by the numeral 88, includes a pair of parallel legs 90, which are pivotably attached at one end to the bars 80, 82 by rivets 92, and which mount a lower crosspiece 91; the crosspiece supports a pair of wheels 94 at its opposite ends. J-shaped guards 96 are attached to the wheel brackets 98, and extend partially thereabout to permit contact of the wheels 94 through only a limited portion of their periphery.

Two elongated right-angle pieces 100 are disposed above and generally parallel to the bars 80, 82, the upper, horizontal portion 102 of one of which is longitudinally slotted at 104. A bearing block 106 is affixed at the apex of the Vee-component 86, and a pair of connecting rods 108 extend forwardly therefrom and are affixed to the angle pieces 100. Journaled by the bearing block 106 is an assembly of pedals 110 and a sprocket wheel 112, and a pulley 114 is supported within a bearing 118 for rotation between the pieces 100, the bearing in turn being secured by a U-shaped clamping piece 116 which is mounted by nut and bolt fasteners 117 within the slot 104. A gear portion 120 is attached to the opposite end of the pulley shaft and is engaged by the chain 122, which also engages the sprocket 112 to permit driving force to be imparted to the pulley 114 by operation of the pedals 110.

An electric alternator 124 is adjustably mounted on the frame by bolts 126, which are engaged within the slots 128, 130 formed respectively through the vertical portion 132 of the piece 100 and the bar 80. The shaft of the alternator rotor carries a sheave 134 on its outer end, which is connected to the pulley 114 by a flexible belt 136. Due to the ratios of the diameters of the several components, the power generated by rotation of the sprocket 112 will be transmitted through the gear portion 120, the pulley 114, and the sheave 134 to drive the rotor of the alternator 124 at highly multiplied revolution rates.

A control box 138 is connected to the alternator 124 through a suitable cable 140, and an output cable 142 runs from the alternator to a receptacle box 144, which is mounted upon the angle iron pieces 100. The receptacle box has a conventional female outlet, which receives the plug on the end of the wire 146 from a television set, which is generally designated by the numeral 148.

The rearward end portion of the frame supports a central wheel 150 under the Vee-component 86, and a bracket piece 152 extends upwardly therefrom; the bracket piece mounts a laterally extending cylindrical lug 154, which is engaged under a U-shaped clamping element 156 on the coupling sleeve 158. The latter carries a mounting bracket 160 for a visual monitoring unit (not shown), and it has a spring-loaded locking pin 162 extending through its inner end. The sleeve 158 provides an elongated passage through which extends the stem 164 of a T-shaped tie-bar, generally designated by the numeral 166, and the tie-bar has a head portion 168 with a downward flange element; the flange element is engaged within the channel defined behind the upwardly extending lip portion 170 of the bracket piece 76, to thereby disengageably attach the exercising mechanism to the chassis 10 of the housing.

As will be self-evident, the exercising mechanism will normally be collapsed and stored within the housing compartment when not in use, as is most fully illustrated by FIG. 4. In that configuration, the stand assembly 88 is folded forwardly to underlie the bars 80, 82 (elevating the transverse axle 84), and the tie-bar 164 and coupling sleeve 158 are also folded forwardly (by rotation about the lug 154) to the position shown. The collapsed mechanism can readily be inserted into the housing, as is facilitated by the wheels 94 on the stand assembly 88 (the J-shaped guard pieces 96 being upwardly disposed, out of the way, so as to permit the wheels to roll on the floor), the central wheel 150 at the rearward end of the frame, and the ramp elements 48. When the mechanism is fully inserted, the wheel 150 will rest upon the shelf-like bracket 53, and the wheels 94 will seat stably within the depressions provided by the portions 50, to keep the mechanism securely in place.

Figure 6:
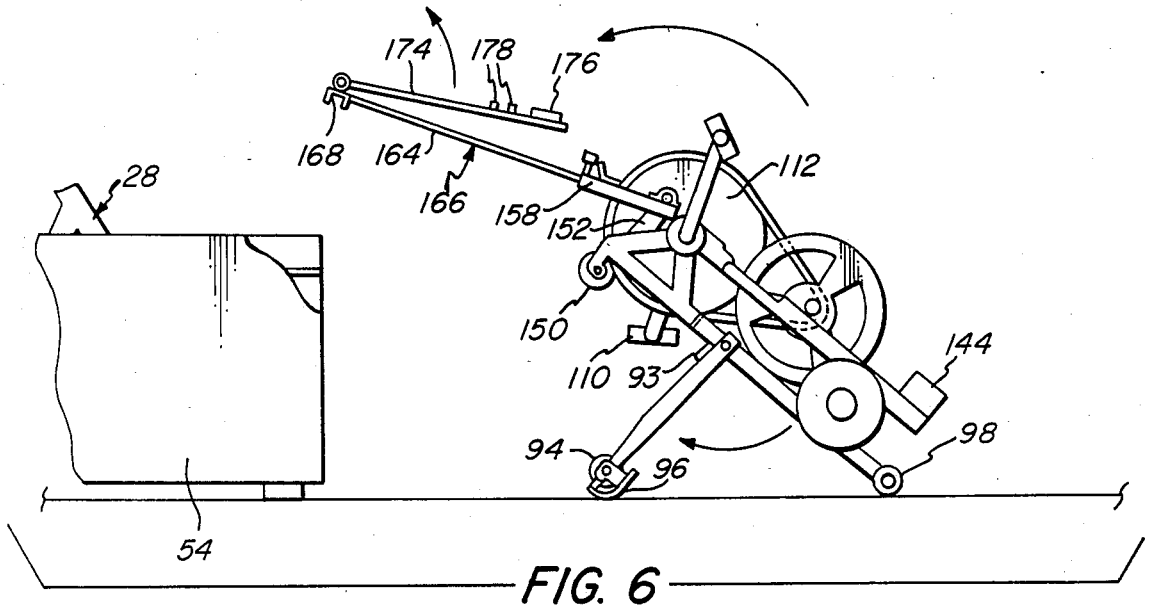
FIG. 6 is a view similar to FIG. 5, fragmentarily illustrating the housing and showing the exercising mechanism somewhat modified, and erected and extended for use.

In preparation for use the end panel 68 is first removed to allow the exercising mechanism to be withdrawn from the housing; then, the coupling piece 158 and the stand assembly 88 are unfolded, as indicated by the arrows in FIG. 6, and tie-bar 166 is affixed to the housing bracket 76. (It will be noted that this Figure shows a modification of the mechanism and differs from the others by the inclusion of a pivoted arm 174, which mounts a display panel 176 and control knobs 178 in lieu of the unit 138; the arm 174 can be elevated to a position generally perpendicular to the stem 164, and secured in place, for easy access to the knobs 178 and convenient viewing of the panel 176.)

In operative position, the guard pieces 96 associated with the wheels 94 rest upon the floor and, in cooperation with the enlarged portions 98 and the axle 84, stably position the mechanism for use; the stop bar 93 between the legs 90 prevents them from pivoting past the point at which the stand assembly 88 is fully extended. The distance the exercising system is spaced from the chair arrangement is of course properly adjusted to suit the comfort and convenience of the user, as may readily be done by selectively engaging the pin 162 in a suitable one of the apertures 172 formed through the stem portion 164 of the tie-bar 166.

Operation of the pedals 110 will, as discussed above, drive the alternator 124 at a high rate of rotation, thereby generating electrical power. The resistance offered by the alternator can be selectively varied through use of the control box 138, the knobs 178, and/or by connecting a load of constant power demand, such as the television set 148, to thereby establish the work level and, in turn, the exercise benefit afforded to the subject.

More particularly, the electrical output from the stator of the alternator will generally be rectified, with some or all of the D.C. current thereby generated being used to power the field winding. The ability to control the field voltage can of course be used to vary the effective resistance to rotation presented to the pedals, and the output from the alternator will depend upon two factors; namely, the field voltage and the rate of roter rotation, the voltage output varying in direct proportion to each.

By proper design of the circuitry incorporated into it, the system can be used to simulate riding a bicycle at constant speed under varying loads (i.e., up and down hills), or at varying speeds under a constant load (i.e., faster or slower on a level surface). For example, by connecting a variable resistor in parallel to the field winding of the alternator, so as to control the voltage applied, the electrical resistance value can be increased (and decreased) so as to create the sensation of pedaling up (and down) hills of varying steepnesses. By using a second resistor, so connected as to establish a predetermined voltage that will be applied to the field independently of variations in the amount of work input, a plateau condition can be simulated in which the energy output will remain constant regardless of the rate of pedal rotation.

The control unit 138 may be sized for hand-held use, as illustrated; alternatively, it may (as shown in FIG. 6) be pivotably attached adjacent the head portion 168 of the tie-bar 166 for most convenient access. In any event, the unit will provide the circuitry and components necessary to take advantage of the variable functions and operational control capabilities of the system. The controls may be used to select the magnitude of the resistance offered and the level at which an energy "plateau" is established. A start button may also be provided for exciting the field of the alternator (although it might also be self-exciting), as may a switch for selecting the desired output to a digital display module (e.g., a choice between an energy read-out in units of watts or calories per minute), such as may be mounted on the bracket 160 or incorporated into the control panel 138, and properly connected (by mans not shown). In addition to the plug-in outlet, the junction box 144 may have a knob-operated voltage selection feature, by which the amount of power drawn by any connected peripheral apparatus can be limited.

It will be appreciated that further size reduction may be advantageous, such as by foreshortening of the unit. One result may however be the elimination from the platform 58 of an area for head support. In that instance, the rearward end panel 56 may also be detachable and capable of assembly with the platform 58 to extend it, and the panel may carry a pillow to better suit it for that purpose, if so desired.

Thus, it can be seen that the present invention provides a novel, self-contained exercise and ottoman-like unit, the latter being convertible to provide a chair in which the user can sit while operating the exercising mechanism. The unit is aesthetically appealing in its closed configuration, and is effective and comfortable for its exercising functions, is of relatively uncomplicated and inexpensive construction, and is readily convertible between its alternative configurations. The invention also provides a novel collapsible exercising mechanism, per se, which is adapted for attachment to and containment within a storage unit; the mechanism is of relatively uncomplicated and inexpensive construction, it is readily collapsed for storage purposes and erected for operation, and is convenient and effective to use.

Having thus described the invention, what is claimed is:

1. An ottoman-like unit convertible to permit use for exercising in seated position, comprising: a housing defining an interior storage compartment and including a floor-supported chassis providing upper horizontal support structure, and vertical support structure at the forward end thereof; a displaceable platform member dimensioned and configured to span and substantially cover the top of said chassis when disposed in a normal position on said horizontal support structure; means on said chassis mounting said platform member for movement between said normal position and an alternative erected position extending obliquely from a location spaced from said forward end and across said chassis; an end panel dimensioned and configured to extend across said forward end of said chassis and over a substantial portion of the height thereof; means disengageably mounting said end panel in a normal position across said forward end of said chassis, said horizontal support structure being adapted to support said end panel in a generally horizontal alternative position to extend substantially across said chassis and between said spaced location and said forward end thereof, said platform member and end panel cooperatively providing a chair arrangement in said alternative positions thereof serving, respectively, as a backrest and a seat; and a leg exercising mechanism adapted for containment within said storage compartment of said housing, and for attachment thereto in a forwardly extended position for operation by a person seated in said chair arrangement.

2. The unit of claim 1 wherein said mounting means for said platform member comprises a stand piece including an elongated leg that is pivotably mounted to said chassis at one end and that pivotably mounts said platform member at a point spaced therefrom, said stand piece and platform member having means thereon for cooperatively affixing said platform member against relative pivotal movement in said erected, alternative position thereof.

3. The unit of claim 2 wherein said stand piece has a foot portion projecting from said leg and disposed to support said stand piece in said alternative position of said platform member, said chassis having an opening therein to accommodate said foot portion in said normal position of said platform member, and having an abutment piece mounted thereon for selective positioning over and displaced from said opening, said abutment piece providing underlying support for said foot portion when positioned over said opening to enable said stand piece to support said platform member in said alternative position thereof.

4. The unit of claim 1 wherein said chassis has a bracket disposed at said forward end thereof, said bracket providing said vertical support structure and the means by which said exercising mechanism is attached to said housing.

5. The unit of claim 1 wherein said end panel and chassis have cooperating means thereon for disposing said end panel in a forwardly inclined orientation, to lie in a substantially right-angular relationship to said platform member in said alternative positions thereof.

6. The unit of claim 1 wherein said chassis additionally includes ramp structure for facilitating insertion and removal of said exercising mechanism into and from said compartment of said housing, and wherein said mechanism includes means adapted for cooperation with said ramp structure.

7. The unit of claim 1 wherein said platform member mounting means selectively affords a plurality of such alternative erected positions.

8. The unit of claim 1 wherein said housing has at least one ground engaging wheel thereon to facilitate movement of said unit from place-to-place, and positional adjustment.

9. A free-standing, collapsible exercising mechanism adapted for attachment to and containment within a storage unit, comprising: an elongated frame having ground-engaging members adjacent its opposite ends; an exercising system on said frame, including operatively interconnected dynamic resistance means and manual drive means; an attaching member mounted on said frame for extension rearwardly therefrom in an outer end portion adapted for attachment to independent anchoring means, said attaching member being of variable effective length to permit said outer end portion to be fixed in each of as plurality of positions spaced by different distances from said frame, said attaching member also being adapted to permit variation of the vertical position of said outer end portion relative to said frame; and a supporting member adapted to provide underlying support for said frame, said supporting member being mounted on said frame for movement between a storage position proximate thereto and a supporting position extended downwardly therefrom, said supporting member having an outer end portion with ground-engaging means thereon capable of stably engaging an underlying surface to cooperatively render said mechanism free-standing.

10. The mechanism of claim 9 wherein said attaching member is mounted on said frame for movement between a storage position proximate thereto and said attaching position and wherein said attaching and supporting members are rigid and elongated and are pivotably mounted on said frame, said members extending along the top and bottom of said frame, respectively, in said storage positions thereof.

11. The mechanism of claim 9 wherein said ground-engaging member adjacent one end of said frame comprises a rolling member, and wherein, in sad storage position of said supporting member, said ground-engaging means on said supporting member is disposed adjacent the other end of said frame and is capable of rollingly engaging the underlying surface, said ground-engaging member on said one end of said frame, and said ground-engaging means on said supporting ember thereby cooperatively supporting said mechanism and rendering it rollable, on an underlying surface, in the collapsed condition thereof.

12. The mechanism of claim 9 wherein said ground-engaging means on said supporting member comprises a wheel and a rigid guard piece extending partially thereabout, said wheel being accessible for contact by an underlying surface in said storage position of said supporting member, and said guard piece being interposed under said wheel in said supporting position of said supporting member, to provide stable support for said mechanism.

13. The mechanism of claim 10 wherein said supporting member is mounted on said frame intermediate said opposite ends thereof, and contacts said frame at locations spaced from the point of pivotal attachment in both of said positions, said supporting member elevating said ground-engaging means adjacent said other end of said frame in said storage position, and elevating said ground-engaging means adjacent said one end in said supporting position thereof.

14. The mechanism of claim 9 wherein said manual drive means of said exercising system comprises a wheel and pedal assembly rotatably mounted on said frame, said assembly adapting said mechanism for leg exercising operation.

15. The mechanism of claim 14 wherein said resistance means of said exercising system is capable of offering selectively variable resistances.

16. The mechanism of claim 15 wherein said resistance means is an electric machine having a stator and a magnetically coupled rotor, and having means for selectively varying the strength of the magnetic field coupling said rotor and stator to provide such selectively variable resistance.

17. The mechanism of claim 15 wherein said exercising system comprises an alternator and a pulley operatively interconnected between said alternator and said wheel by power transmission means, said pulley,, wheel, transmission means and alternator being adapted to multiply the revolutions rate produced by rotation of said wheel, as received by said alternator.

18. The mechanism of claim 16 wherein said system includes connecting means for electrically connecting external devices to said machine for imposing resistance loads thereupon.

19. The mechanism of claim 18 wherein said connecting means is an electric plug receptacle.

20. An ottoman-like unit convertible to permit use for exercising in seated position, comprising: a housing defining an interior storage compartment and including a floor-supported chassis providing upper horizontal support structure, and vertical support structure at the forward end thereof; a displaceable platform member dimensioned and configured to span and substantially cover the top of said chassis when disposed in a normal position on said horizontal support structure; means on said chassis mounting said platform member for movement between said normal position and an alternative erected position extending obliquely from a location spaced from said forward end and across said chassis; an end panel dimensioned and configured to extend across said forward end of said chassis and over a substantial portion of the height thereof; means disengageably mounting said end panel in a normal position across said forward end of said chassis, said horizontal support structure being adapted to support said end panel in a generally horizontal alternative position to extend substantially across said chassis and between said spaced location and said forward end thereof, said platform member and end panel cooperatively providing a chair arrangement in said alternative positions thereof serving, respectively, as a backrest and a seat; and a collapsible leg exercising mechanism adapted for containment within said storage compartment of said housing, and for attachment thereto in a forwardly extended position for operation by a person seated in said chair arrangement, said exercising mechanism comprising: an elongated frame having ground-engaging members adjacent its opposite ends; an exercising system on said frame, including operatively interconnected dynamic resistance means and manual drive means; an attaching member adapted for attachment of said frame to said housing; and a supporting member adapted to provide underlying support for said frame, said supporting member being mounted on said frame for movement between a storage position proximate thereto and a supporting position extended downwardly therefrom, said supporting member having an outer end portion with ground-engaging means thereon capable of stably engaging an underlying surface.

21. The mechanism of claim 9 wherein said manual drive means comprises a wheel and pedal assembly mounted on said frame for rotation about a fixed axis, and wherein the location at which said attaching member is mounted on said frame is adjacent said fixed axis.

22. The mechanism of claim 9 wherein said attaching member comprises a plurality of parts, one of said parts having said outer end portion thereon, and means for disengagably affixing said one part to another of said parts in a plurality of predetermined relative positions, to provide said plurality of positions of said outer end portion.

23. A collapsible exercising mechanisms adapted for attachment to and containment within a storage unit, comprising: an elongated frame having ground-engaging members adjacent its opposite ends; an exercising system on said frame, including operatively interconnected dynamic resistance means and manual drive means; an attaching member adapted for attachment of said frame to a storage unit; and a supporting member adapted to provide underlying support or said frame, said supporting member being mounted on said frame for movement between a storage position proximate thereto and a supporting position extended downwardly therefrom, said supporting member having an outer end portion with ground-engaging means thereon capable of stably engaging an underlying surface, said attaching member being mounted on said frame for movement between a storage position proximate thereto and an attaching position extended rearwardly therefrom, said attaching and supporting members being rigid and elongated, and pivotably mounted on said frame, said members extending along the top and bottom of said frame, respectively, in said storage positions thereof.

24. A free-standing, collapsible exercising mechanism adapted for attachment to and containment within a storage unit, comprising: an elongated frame having ground-engaging members adjacent its opposite ends; an exercising system on said frame, including operatively interconnected dynamic resistance means and manual drive means; an attaching member adapted for attachment of said frame to independent anchoring means; and a supporting member adapted to provide underlying support for said frame, said supporting member being mounted on said frame for movement between a storage position proximate thereto and a supporting position extended downwardly therefrom, said supported member having an outer end portion with ground-engaging means thereon capable of stably engaging an underlying surface, to render said mechanism free-standing, said ground-engaging means comprising a wheel and a rigid guard piece extending partially thereabout, said wheel being accessible for contact by an underlying surface in said storage position of said supporting member, and said guard piece being interposed under said wheel in said supporting position of said supporting member, to provide stable support for said mechanism.

* * * * *

UNITED STATES PATENT AND TRADEMARK OFFICE

CERTIFICATE OF CORRECTION

PATENT NO. : 4,805,901

DATED : February 21, 1989

INVENTOR(S) : John M. Kulick

It is certified that error appears in the above-identified patent and that said Letters Patent is hereby corrected as shown below:

Claim 9, line 8, column 10; insert after the word "an" -- attaching position and having an -- ;

Claim 11, line 36, column 10; delete the word "sad" and substitute therefor -- said --;

Claim 11, line 42, column 10; delete the word "ember" and substitute therefor -- member --;

Claim 23, line 23, column 12; delete the word "or" and substitute therefor -- for --;

Claim 24, line 52, column 12; delete the word "supported" and substitute therfor -- supporting --

Signed and Sealed this

Twenty-second Day of May, 1990

*Attest:*

*Attesting Officer*

HARRY F. MANBECK, JR.

*Commissioner of Patents and Trademarks*